US007290557B1

(12) United States Patent
Bowman

(10) Patent No.: US 7,290,557 B1
(45) Date of Patent: Nov. 6, 2007

(54) DRAIN LINE ADAPTER AIR GAP FITTING

(76) Inventor: Dennis E. Bowman, 17340 Walnut La., Rogers, AR (US) 72756

( * ) Notice: Subject to any disclaimer, the term of this patent is extended or adjusted under 35 U.S.C. 154(b) by 200 days.

(21) Appl. No.: 11/257,314

(22) Filed: Oct. 24, 2005

Related U.S. Application Data

(60) Provisional application No. 60/643,247, filed on Jan. 12, 2005.

(51) Int. Cl.
*E03C 1/10* (2006.01)

(52) U.S. Cl. ..... 137/216

(58) Field of Classification Search ..... 137/216
See application file for complete search history.

(56) References Cited

U.S. PATENT DOCUMENTS

| | | | |
|---|---|---|---|
| 2,122,051 | A | 6/1938 | Baird |
| 2,878,826 | A | 3/1959 | Dolenga |
| 3,183,923 | A | 5/1965 | Henrikson |
| 3,346,887 | A | 10/1967 | Sommer |
| 3,620,241 | A | 11/1971 | Brown |
| 3,716,143 | A | 2/1973 | Clark |
| 3,786,924 | A | 1/1974 | Huffman |
| 3,856,672 | A | 12/1974 | Boswinkle et al. |
| 3,929,149 | A | 12/1975 | Phillips |
| 3,967,638 | A | 7/1976 | Tondreau |
| 4,071,445 | A | 1/1978 | Katayama et al. |
| 4,134,419 | A | 1/1979 | Richetti |
| 4,454,891 | A | 6/1984 | Dreibelbis et al. |
| 4,646,775 | A | 3/1987 | Traylor |
| 4,771,485 | A | 9/1988 | Traylor |
| 4,812,237 | A | 3/1989 | Cawley et al. |
| 4,856,121 | A | 8/1989 | Traylor |
| 4,917,847 | A | 4/1990 | Solomon |
| 4,944,877 | A | 7/1990 | Maples |
| 4,967,784 | A | 11/1990 | Barhydt, Sr. et al. |
| 5,006,234 | A | 4/1991 | Menon et al. |
| 5,152,321 | A | 10/1992 | Drager et al. |
| 5,176,165 | A | 1/1993 | Traylor |
| 5,305,778 | A | 4/1994 | Traylor |
| 5,449,456 | A | 9/1995 | Bowman |
| 5,635,058 | A | 6/1997 | Bowman |
| 5,681,459 | A | 10/1997 | Bowman |
| 5,713,385 | A | 2/1998 | Traylor |
| 5,721,411 | A | 2/1998 | Ervin |
| 5,875,809 | A | 3/1999 | Barrom |

(Continued)

*Primary Examiner*—Eric Keasel
*Assistant Examiner*—Craig Schneider
(74) *Attorney, Agent, or Firm*—Reising, Ethington, Barnes, Kisselle, P.C.; William J. Waugaman

(57) ABSTRACT

An air gap fitting and method for fluid flow coupling an appliance waste water discharge outlet to a sewer stand pipe inlet. A bell-shaped hood has a side wall skirt tapering downwardly divergently to a skirt lower edge outlet dimensioned to telescopically receive the open upper inlet end of a sewer stand pipe until it abuts a 360° internal slip-stop skirt shoulder. A single hood air vent exterior opening extends axially of the skirt approximately two inches. An interior central drain tube extends downwardly and terminates flush with the hood air vent opening lower edge. A tube air vent gap slot is oriented 180° out of alignment with the hood exterior air vent. A hexagonal protrusion on the hood upper end receives a wrench to rotate or hold the fitting, and accommodates forming a ½" or ¾" I.D. female threaded hood inlet.

10 Claims, 5 Drawing Sheets

U.S. PATENT DOCUMENTS

| | | | |
|---|---|---|---|
| 5,899,234 | A | 5/1999 | Senninger |
| 5,944,985 | A | 8/1999 | Bowman |
| 6,193,879 | B1 | 2/2001 | Bowman |
| 6,453,931 | B1 | 9/2002 | Traylor |
| 6,510,863 | B1 | 1/2003 | Traylor |
| 6,651,272 | B2 | 11/2003 | Bowman |
| 6,971,400 | B1 | 12/2005 | Bowman et al. |

DRAIN LINE ADAPTER AIR GAP FITTING

This is a United States regular utility patent application filed pursuant to 35 U.S.C. § 111(a) and claiming the benefit of the priority under 35 U.S.C. § 119(e)(1) of U.S. provisional application Ser. No. 60/643,247 filed Jan. 12, 2005, such provisional application being incorporated herein by reference in toto.

FIELD OF THE INVENTION

This invention relates to plumbing and water treatment products in the nature of air gap configurations for residential and commercial water treatment equipment and condensation lines requiring an air gap discharged to the drain.

BACKGROUND OF THE INVENTION

Residential and commercial water consuming and water treating appliances are almost universally now required, for installation, to conform to one or more local or state plumbing codes such as IAPMO Uniform Plumbing Code, ICC International Plumbing Code, BOCA or SBCCI. These codes require using a sufficient "air gap system" for safe drainage of waste water from a water treatment appliance to a house main drain or sewer pipe. The air gap is typically provided by a specially designed plumbing fixture or hardware that connects the outlet of the appliance drain line to the inlet of the sewer pipe, and in doing so provides an opening that forms an "air gap", i.e., the vertical distance through the atmosphere between the lowest potable water connection outlet and the highest level of the source of fluid contamination. The air gap device thus ensures a point of separation of potable and non-potable conduits in the overall plumbing system. Such an air gap installation thereby avoids a direct drain connection to a sewer system, a so-called "cross connection", that otherwise would provide a risk of contamination when a sewer backs up or when there is a loss of pressure in the fluid supply or water supply side of the system. This may occur, for example, when a system pump fails to run and thereby causes a back-siphon effect that in turn causes water flow from the sewerage system into the house's potable water system. A fire fighting pumper can also cause a suction in the water supply system that in turn causes water to be sucked back up from the sewer system.

In addition, in order to accommodate the greater pressures and flow rate requirements from the latest high-capacity water softeners and commercial reverse osmosis filtration systems, some local and state plumbing codes now often dictate that a rigid Schedule-40 line be plumbed to the air gap and drain line of the appliance in order to accommodate the greater pressures and flow rate requirements from these more recent appliances providing a more solid and failsafe connection. Moreover, despite the abundant types and designs of various air gap fittings available on the market, a new design for high flow rate Schedule-40 stand pipe air gaps has been requested by numerous plumbing supply houses, plumbing contractors and water treatment equipment installers around the country and abroad as a result of the new high-performance "Dual Head" water softener controls with high discharge rates. Appliance manufacturers have not been provided with the necessary plumbing drain connection fittings to satisfy the plumbing codes in many locales. This situation has lead to the installer creating some kind of on-site connection that will get the discharge water into the drain, but will not in many cases, depending upon the plumbing inspector and local plumbing codes, pass the required plumbing inspection to meet the applicable code.

The prior art is replete with various plumbing fittings designed to serve an air gap function. One example of an improved tubular air gap product is the Model DLA-G manufactured and sold by Eco-Tech, Inc. of Rogers, Ark. and disclosed and claimed in U.S. Pat. No. 5,681,459 issued Oct. 28, 1997 and naming as inventor the inventor herein, Dennis E. Bowman and illustrated in FIGS. 36-38 thereof. The Model DLA-G is a tubular product designed for connection of the outlet end of this air gap fitting to Schedule-40 pipe by way of a male Schedule-40 trap adapter using an S.J. nut and washer. However, the inlet of the DLA-G air gap fitting is designed to receive only various sizes of tubing, typically reverse osmosis and water softener waste water drain line tubing.

Another example of a prior air gap fitting for Schedule-40 drain pipes is that shown on the web site www.abetterairgap.com on page 3 of the product information section and identified as the "BA2 Air Gap". However, this design fails to meet the needs now satisfied by the air gap constructions of the present invention as disclosed hereinafter.

Accordingly, among one or more of the objects of the present invention is to provide (1) an improved air gap fitting that will function as a drain line adapter connection to a rigid Schedule-40 stand pipe drain, i.e., an ABS or PVC Schedule-40 standpipe having an outside diameter (O.D.) of either 1½ inches or 2 inches; (2) an improved air gap fitting designed to the strict tolerances of the appropriate ASTM standards governing ABS Schedule-40 fittings; (3) an improved air gap fitting having an easy hold hex head to receive a wrench to rotate the fitting or resist rotation of the fitting as needed, (4) moldable in one piece from durable ABS or PVC plastic; (5) an improved air gap fitting available in inlet inner diameters (I.D.) of ½ inch, ¾ inch or 1 inch and provided with national pipe thread (NPT, e.g., FIPT) standard female threads in the inlet to thereby readily accommodate various conventional plastic, copper, brass or steel adapter fittings typically provided as shelf items for connecting to the air gap fitting when installing the same on a rigid Schedule-40 drain pipe; (6) an air gap fitting having an inner drain tube with an air gap side opening having a vertical extent of at least 2 inches and oriented so as to be rotated 180° away from a single outer air gap window side opening in the fitting hood that also has a vertical extent of approximately 2 inches and is vertically at the same elevation as the inner tube air gap opening to thereby accommodate high flow rates without splashing liquid out of the air gap; (7) that can be telescoped at its outlet end over a 1½ inch ABS or PVC stand pipe and adherently affixed thereto using ABS or ABS/PVC cement, and also can be telescoped to slip into and telescope inside an ABS or PVC vertical 2 inch Schedule-40 drain waste and vent (DWV) coupling hub fitting; (8) the easy hold hex head protrusion at the inlet end of the fitting is made with an outside dimension large enough to accommodate forming either ½ inch or ¾ inch I.D. female threads in the inlet opening; and (9) a full 360° circular interior ledge recessed axially inwardly from the outlet end of the air gap fitting to provide an accurate and rugged slip-stop for the air gap when it is being installed telescopically over the outside of the inlet end of the drain pipe.

BRIEF DESCRIPTION OF THE DRAWINGS

Other objects, features and advantages of the present invention will become apparent from the following detailed description, appended claims and accompanying drawings (which are drawn to engineering scale unless otherwise indicated), in the several figures of which like reference numerals identify like elements, and wherein:

DETAILED DESCRIPTION OF PREFERRED EMBODIMENTS

Referring now in more detail to the accompanying drawings, a multi-purpose drain line adapter air gap fitting construction of the invention has been commercially embodied, by way of example, in three embodiments available as three part numbers from Eco-Tech, Inc., located at 17340 Walnut Lane, Rogers, Ark. 72756, namely, (1) air gap fitting 150 available as part no. G-150 shown by itself in detail in FIGS. 8, 11, 13 and 14; (2) air gap fitting 110 available as part no. G-175 shown by itself in FIGS. 9, 11, 15 and 16; and (3) air gap fitting 170 available as part no. G-200 shown by itself in FIGS. 10, 12 17 and 18.

FIGS. 1, 2, 3 and 4 illustrate four different air gap drain line installations in which one or more of each of the aforementioned three air gap fitting parts are employed to couple a drain line from a water consuming and/or treating appliance to a sewer drain system.

Figure 1:
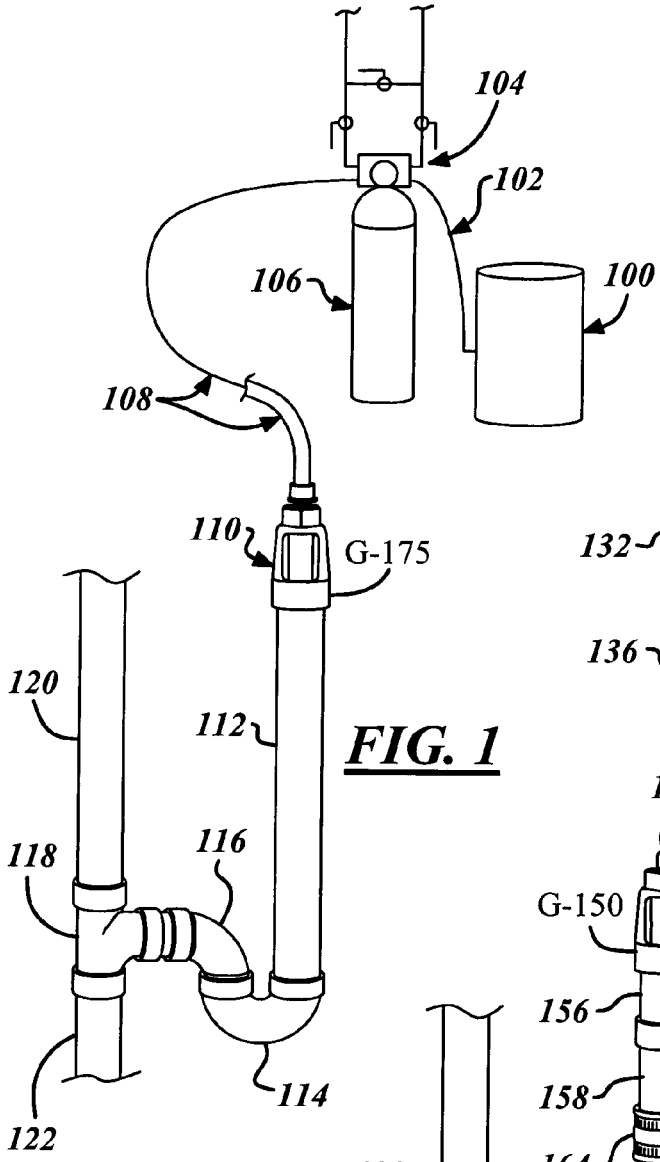
FIG. 1 is a fragmentary part elevational and part schematic view of a commercial water softener installation utilizing a G-175 embodiment of an air gap fitting of the invention designed for use as a drain line adapter in accordance with the present invention.

FIG. 1 illustrates a commercially available water softening appliance set-up including a conventional brine tank 100 connected by line 102 to the high-performance "Dual Head" water softener control system 104 of a water softener 106. Such commercially available water softening appliances, whether used alone or in conjunction with reverse osmosis (R/O) water filter systems, have a waste water bypass system operable during the back flushing cycle, and hence have a back flush drain tube 108 which needs to be coupled to a sewer drainage system or the like, but without creating the aforementioned illegal "cross connection". In the system of FIG. 1, this is accomplished in accordance with the invention by utilizing a multi-purpose air gap fitting constructed as a drain line adapter 110 for coupling waste drain line 108 at its outlet end to the upper end of a conventional 1½" rigid Schedule-40 ABS or PVC stand pipe riser 112. Riser 112 is in turn coupled at its outlet via a 1½" Schedule-40 P-trap 114 and a 1½" Schedule-40 street elbow 116 to the side branch inlet of a 1½" Schedule-40 sanitary Tee 118. A 1½" Schedule-40 sewer vent pipe 120 is connected to the upper end of the through-section of Tee 118, while a 1½" Schedule-40 sewer pipe 122 is coupled to the lower outlet end of Tee 118. Plumbing components 114, 116, 118, 120 and 122 are likewise rigid ABS or PVC parts. Adapter 110 is preferably the aforementioned part no. G-175 made and sold by Eco-Tech, Inc., and will be described in more detail hereinafter.

Figure 2:
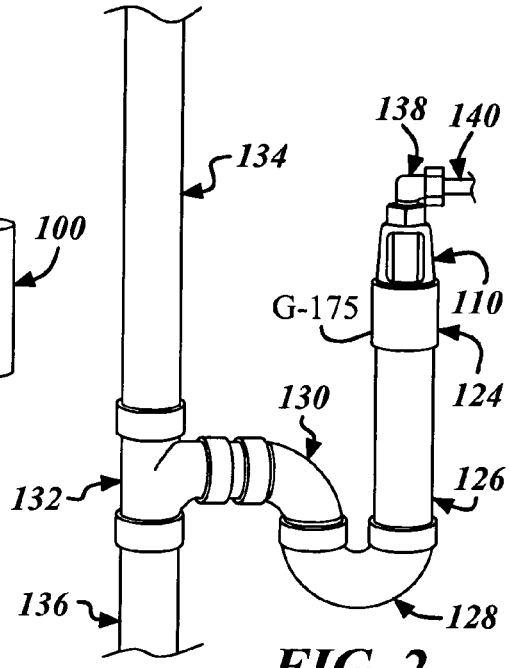
FIG. 2 is a fragmentary elevational and perspective view of the G-175 air gap fitting of FIG. 1 installed on a 2 inch stand pipe riser using a coupling hub as shown in FIGS. 6 and 7.
Figure 6:
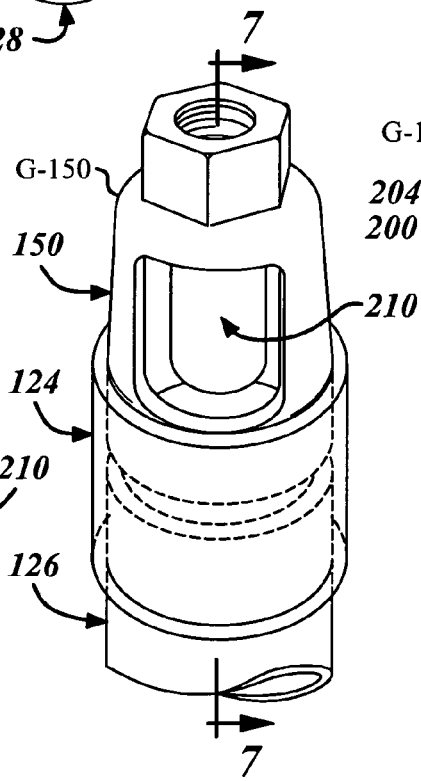
FIG. 6 is a fragmentary perspective view of the G-150 adapter of FIG. 5 mounted inside a connector hub in turn telescoped over the outside of a 2 inch I.D. Schedule-40 ABS or PVC stand pipe.
Figure 7:
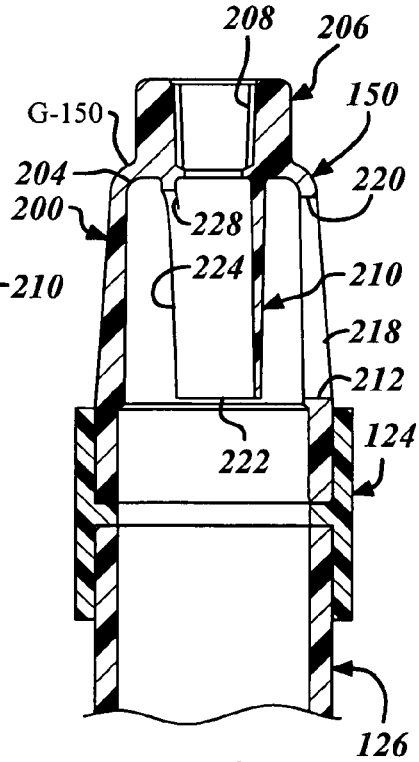
FIG. 7 is a fragmentary cross sectional view taken on the line 7-7 of FIG. 6.

FIG. 2 illustrates a 2" Schedule-40 rigid ABS or PVC sanitary pipe sewer drain set-up wherein adapter 110 is telescopically received within the upper end of a 2" ABS or PVC Schedule-40 coupling hub 124, as shown in more detail in FIGS. 6 and 7. Coupling hub 124 in turn is telescopically received over the outside surface of a 2" Schedule-40 drain stand pipe riser 126 that in turn is cemented into the inlet end of a P-trap 128 coupled via a 2" Schedule-40 street elbow 130 to a 2" Schedule-40 sanitary Tee 132. A 2" Schedule-40 vent pipe 134 is received into the upper end of Tee 132 and a 2" Schedule-40 sewer pipe 136 is received into the lower end of Tee 132.

Adapter 110 has threaded into its upper end an adapter coupling elbow 138 of the compression fitting type for coupling a waste water drain line 140 into adapter 110. Adapter elbow 138 is thus similar to the straight line compression adapter of FIG. 19, except that it is constructed as an elbow fitting.

Figure 3:
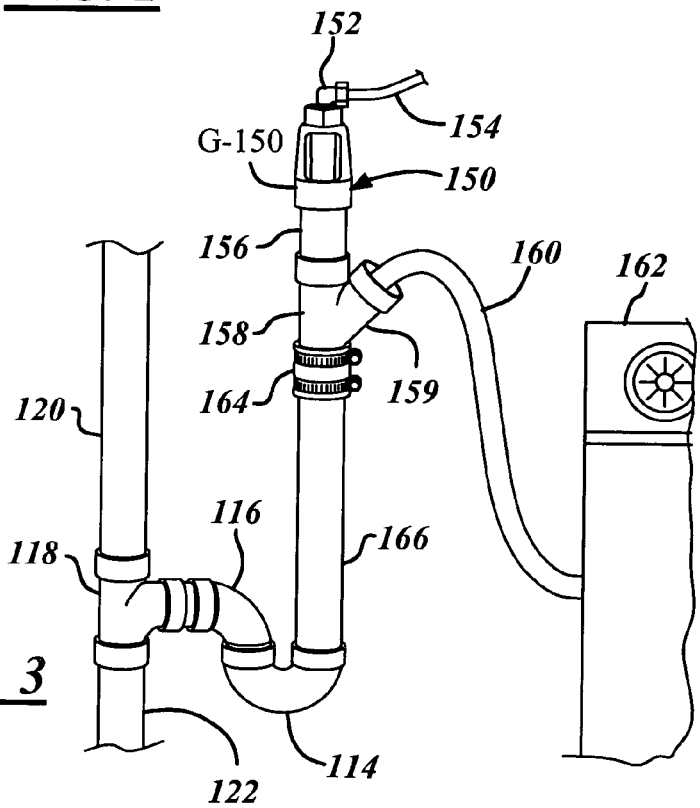
FIG. 3 is a fragmentary elevational and perspective view of a dual waste water drain set-up for conventionally coupling the outlet of the drain hose of the typical washing machine loosely feeding into an inlet angled branch of a Street Wye, and a reverse osmosis ("R/O") waste water drain tube feeding into the upper end of a G-150 embodiment of the air gap fitting of the invention that is adhesively mounted on a straight sleeve in turn glued into the main inlet of a Street Wye.

FIG. 3 illustrates drain line adapter air gap fitting 150, which is commercially embodied as part no. G-150 that is shown in detail in FIGS. 8, 13 and 14. Fitting 150 is identical to fitting 110 (part G-175) except for the inside diameter of the threaded inlet 208 of the fitting part G-150 having a 1½"-14 NPT threaded inlet specification, whereas fitting 110 (part G-175) has a ¾"-14 NPT female threaded inlet opening 209. Thus, in FIG. 3 adapter 150 receives in its upper end a ½" elbow fitting 152 of the compression type for coupling a ⅜" drain tube 154 to the upper end of adapter 150. Adapter 150 is shown telescoped over and cemented to the upper end of a 1½" straight Schedule-40 sleeve section or pipe 156 that in turn is glued into the upper end of a 1½" Street Wye Schedule-40 ABS or PVC fitting. A drain hose 160 of a washing machine 162 is inserted loosely into the inlet of wye branch 159 of fitting 158. The lower end of wye 158 is coupled by a 1½" no-hub connector 164 to the upper end of a 1½" Schedule-40 stand pipe riser 166 in turn coupled to vent pipe 120 and sewer pipe 122 by the same trap and elbow components shown in FIG. 1.

Figure 4:
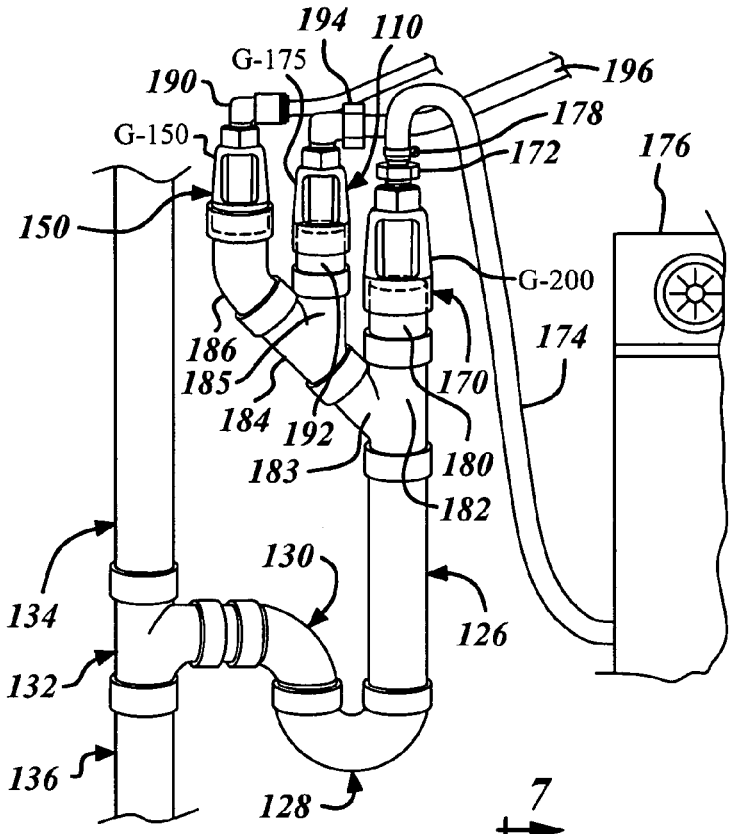
FIG. 4 is a fragmentary elevational and perspective view of a multiple waste water drain hook-up utilizing three embodiments (i.e., parts G-150, G-175 and G-200) of the air gap fitting drain line adapter of the invention for coupling (1) an R/O waste water drain line of ½ inch diameter, (2) a water softener drain line of ⅝ inch O.D. diameter, and (3) a commercial dishwashing drain line of a 1 inch diameter respectively to a 1½" Street 45, a 1½" Street Wye and a 2"×1½" Wye.

FIG. 4 illustrates the use and installation of a third embodiment drain line adapter air gap fitting 170 that is available as part no G-200 from Eco-Tech, Inc. and is shown by itself in FIGS. 10, 12, 17 and 18. The inside diameter of the lower open end of adapter 170 is sized to enable adapter 170 to be telescopically slipped over and receive the upper end of 2" Schedule-40 no-hub sleeves or stand pipes. Hence, in FIG. 4 adapter 170 is shown with a 1" barb fitting 172 threaded into its upper end and receiving thereon the outlet end of a drain hose 174 of a commercial dishwasher 176. A hose clamp 178 is employed to clamp the outlet end of hose 174 onto barb fitting 172. The open lower end of adapter 170 telescopically receives the upper end of a straight section 2" Schedule-40 connector pipe sleeve 180, which in turn fits into the upper end of a 2"×1½" Wye 182. A lower end of Wye 182 receives therein the upper end of stand pipe riser 126, which in turn is coupled via P-trap 128, elbow 130 and Sanitary Tee 132 to the vent pipe 134 in sewer pipe 136 as in FIG. 2.

The 1½" branch 183 of fitting 182 receives a spigot end of a 1½" Schedule-40 Street Wye 184. A 1½" Street 45 part 186 is glued into the through-hub of Wye 184. Adapter 150 is mounted into the 1½" hub upper end of the Street 45 part 186. A 1½" elbow push-in adapter 190 is threaded into the upper end of adapter 150 and receives a ⅜" OD flexible tubing drain line 191 from an RIO unit (not shown), adapter 190 being shown in detail in FIG. 21. The branch 185 of the 1½" Street Wye 184 receives a connector pipe sleeve 192 that in turn receives on its upper end as telescoped thereover adapter 110. A ¾" elbow compression type adapter 194 threads into the upper inlet 209 of adapter 110 and secures the outlet end of a ⅝" O.D. diameter drain line 196 from a water softener appliance (not shown) to serve as a waste water drain line therefrom.

Figure 5:
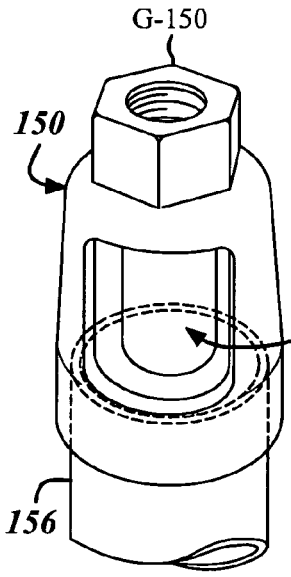
FIG. 5 is a fragmentary perspective view of a G-150 adapter embodiment of the invention mounted on 1½ inch I.D. stand pipe riser as viewed looking at the air gap window side of the adapter.

FIG. 5 illustrates in perspective the adapter 150 (part no. G-150) fitted over a straight section of ABS or PVC schedule-40 pipe 156 as in FIG. 3. FIGS. 6 and 7 illustrate the adapter 150 (part no. G-150) fitted inside the 1½" ABS or PVC Schedule-40 coupling hub 124 that in turn is fitted over the outside of the 2" Schedule-40 stand pipe riser 126 similar to the illustration of adapter 110 part G-175) in FIG. 2.

Figure 8:
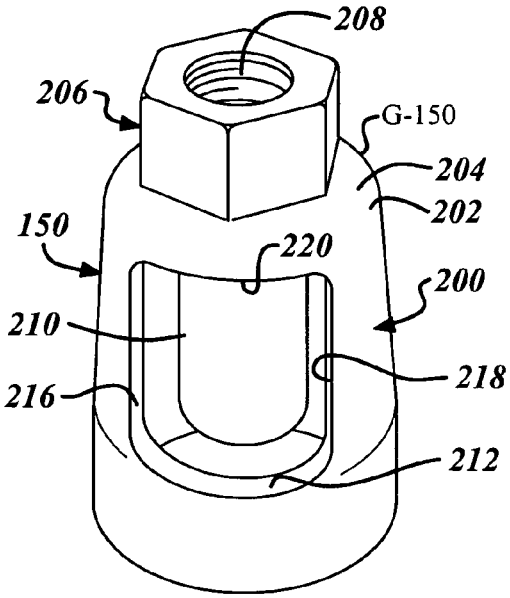
FIGS. 8-10 are respectively perspective views of the G-150, G-175 and G-200 adapters of the invention shown by themselves, as viewed from the air gap window side of the outer hood and from slightly thereabove.
Figure 9:
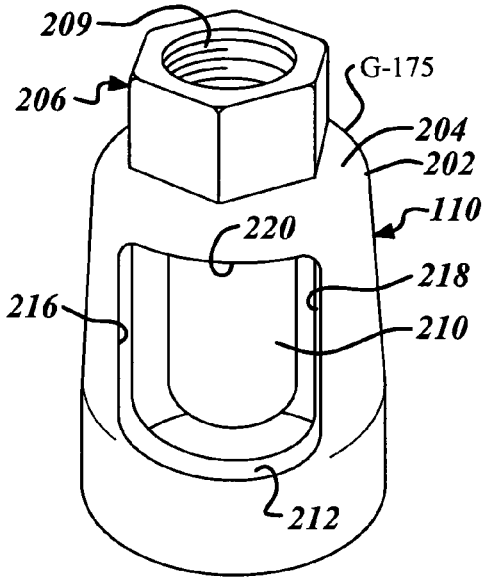
Figure 10:
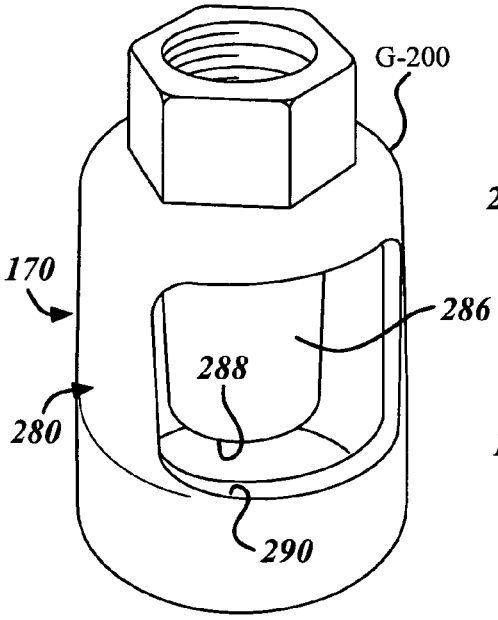
Figure 13:
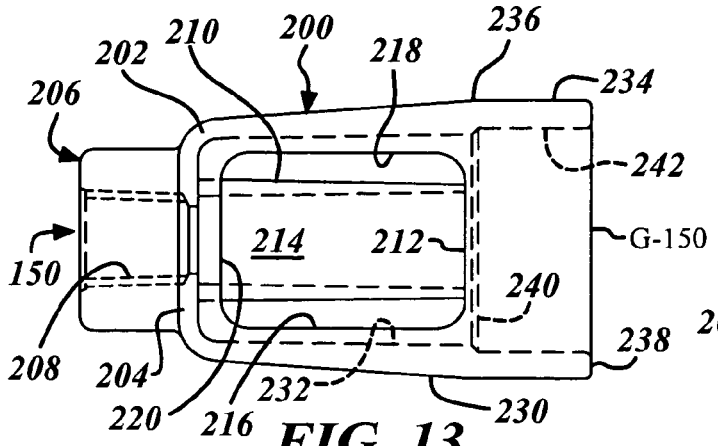
FIGS. 13 and 14 are respectively side elevational and upper end plan views of a part G-150 adapter.
Figure 14:
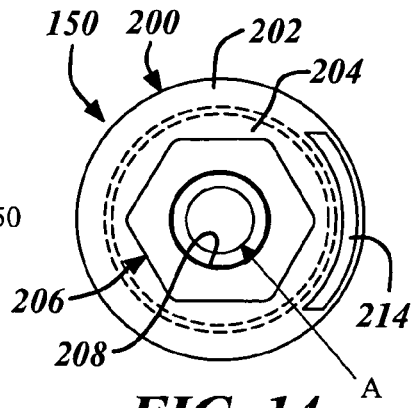

FIGS. 8, 13 and 14 illustrate in more detail the air gap fitting 150 (part G-150) by itself. Adapter 150 has a bell-shaped hood 200 that terminates at its upper end in a curved shoulder 202 that merges into a radially extending cross wall 204. A hexagonally shaped boss 206 protrudes upwardly integrally from wall 204 and has an inlet through-passage 208 extending therethrough open at the upper end of adapter 150 and entering into an interior drain tube 210.

FIGS. 5, 6 and 7 illustrate one of the principal features of the present invention with respect to adapters 110 and 150 (i.e., part nos. G-175 and G-150), namely their versatility in being mountable telescopically over the O.D. of standard 1½" Schedule-40 ABS or PVC pipe, as shown by adapter 150 telescoped over the outside of the upper end of 1½" Schedule-40 pipe 156, or telescopically received with a close fit within the upper half of a 2" ABS or PVC Schedule-40 coupling hub 124. The lower half of hub 124 in turn is telescopically received within the upper end of 2" ABS or PVC Schedule-40 pipe 126, as shown in FIGS. 6 and 7. Adapter G-175 is identical to adapter G-150 as shown in these figures for this feature, the only difference being the size of the female threaded inlet openings 208 and 209 in these two adapter parts.

Adapter 150 has an interior drain air vent tube 210 joined integrally to the underside of cross wall 204 and in encircling relation to the outlet of inlet 208. Tube 210 extends axially downwardly integrally from wall 204 to terminate at an outlet end generally flush with the lower edge 212 of an air vent window 214 formed in the sidewall of the hood 200. Air vent window 214 is generally rectangular in configuration as defined by the laterally spaced two side edges 216 and 218 by and the upper edge 220 spaced axially opposite the lower edge 212, as best seen in FIGS. 8 and 13.

Figure 11:
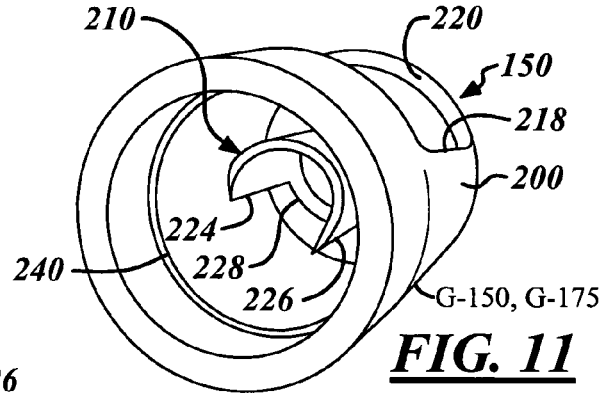
FIG. 11 is a perspective view looking into the outlet end of a part G-150 or part G-175 adapter of the invention oriented with the air gap window in the outer hood facing generally upwardly.

In accordance with another feature of the air gap adapters embodiments of the invention, the interior drain tube 210, as best seen in FIGS. 7 and 11, is open at both its lower end 222 as well as at a backside interior air vent gap extending between gap side edges 224 and 226 (FIG. 11). The upper edge 228 of the interior vent tube gap is formed almost at the cross wall 204 (FIG. 7). Note that the side opening of the interior drain tube 210 that forms an interior air vent between the gap edges 224 and 226 is angularly offset so as to be oriented 180° out of alignment with hood side window 214 that forms the exterior air vent in hood to thereby greatly reduce splash during operation of the air gap adapter 150 as well as noise level even at high flow rates. Orienting lower edge 222 of drain tube 210 generally at the same elevation as lower edge 212 of the side window opening also helps eliminate splash problems.

Another feature of the invention, both adapters 150 and 110 enable the outside telescopic mount of FIG. 5 and, alternatively, the inside telescopic mount of FIGS. 6 and 7 while utilizing the same adapter 150 or 110. The hood 200 of these two adapter parts G-150 and G-175 is specially constructed so as to have a tapering wall thickness increasing in thickness toward the bottom end open mouth of hood 200. This gradually increasing thickness of the hood wall can be seen in FIGS. 13 and 15 wherein the outer surface 230 of hood 200 diverges at a slight taper angle from the interior surface 232 of hood 200. Interior surface 232 is substantially cylindrical except that it does have a 1° draft angle to facilitate extraction from the mold. Surface 230 merges into a substantially cylindrical outer surface 234 that extends from the junction 236 of surface 230 with a surface 234 to the circular bottom edge 238 of hood 200.

Interior hood surface 232 terminates at an internal 360° stop shoulder 240 that is beveled at 45° to merge with a substantially cylindrical pocket surface 242 that extends from shoulder 240 to the lower circular edge 238 of hood 200. Pocket surface 242 has a slight divergent taper toward the open end of the hood as it enlarges from dimension F to dimension E (as labeled in FIG. 15 and set forth in the Dimension Table hereinafter). The diameter of surface 234 is dimension D labeled in FIG. 15 and the diameters of inlets 208 and 209 are set forth and labeled respectively as dimensions A and B. The crest to crest dimension of hex head 206 is set forth as dimension C labeled in FIG. 15 and the distance between opposite flats of head 206 is the dimension M labeled in FIG. 15. The lower edge 238 of hood 200 is established as a base reference point and labeled dimension "G" in FIG. 15. The axial distance dimensioned from G to the lower edge of shoulder 240 is designated at location H, the axial distance from G to the lower window edge 212 is labeled "I" in FIG. 15. The axial distance from G to the upper window edge 220 is labeled "J" in FIG. 15. The distance of shoulder 204 from G is labeled "K" in FIG. 15 and the end surface of hex boss 206 from G is labeled "L" in FIG. 15.

The maximum inside diametric dimension E of mouth pocket 242 is 01.910 inches and tapers down to dimension F of 1.895 inches at stop shoulder 240 so that the spigot upper end of a 1½" Schedule-40 pipe piece will slip closely into mouth pocket 242 when telescoping adapter 150 over pipe 156, as shown in FIG. 5. The few thousandths of an inch starting clearance therebetween allows for the coating of an adhesive cement that will join the two parts with a solvent weld.

On the other hand, when adapter 150 or 110 (parts nos. G-150 or G-175) are to be joined to 2" Schedule-40 ABS or PVC pipe as in FIGS. 6 and 7, a conventional hub coupling 124 is employed which has the same inside diameter as the O.D. of a 2" Schedule-40 pipe length 126. This pipe O.D. dimension is the same as the maximum hood diameter dimension shown as dimension D in FIG. 16, which is specified as 2.375 inches in the dimensional Table hereinafter. This is the standard O.D. dimension of Schedule-40 2" ABS pipe according to the ASTM table, although the ASTM table for PVC pipe tolerances differ so slightly as to accommodate both material specifications. Again, a solvent welded cemented connection is employed in joining connector hub 124 to stand pipe riser 126 and in joining the interior upper surface of hub 124 to a skirt surface 234 of adapters 110 or 150 to form the joint shown in FIGS. 6 and 7.

Figure 19:
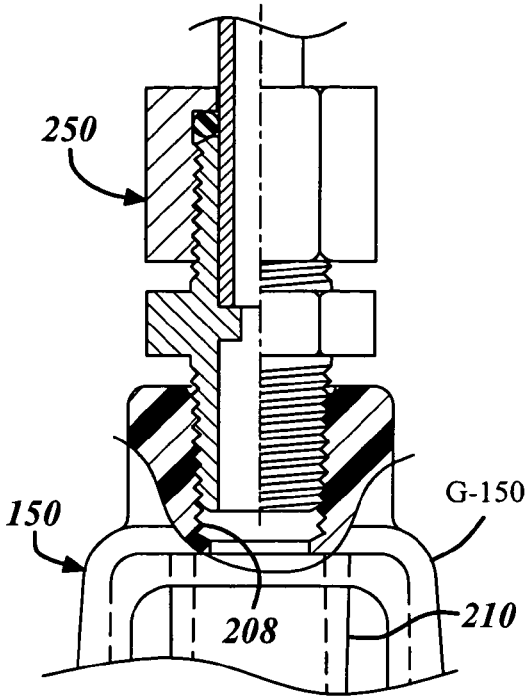
FIGS. 19, 20, 21 and 22 are fragmentary and part outer sectional views of a part G-150 adapter illustrating, respectively mounted thereon, a conventional compression adapter (FIG. 19), a soldered copper tubing adapter (FIG. 20), a push-in elbow adapter (FIG. 21) and a barb insert adapter (FIG. 22).
Figure 20:
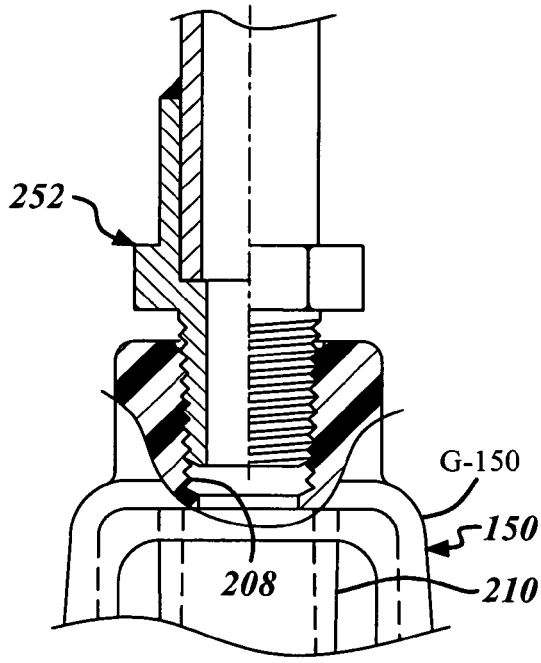
Figure 21:
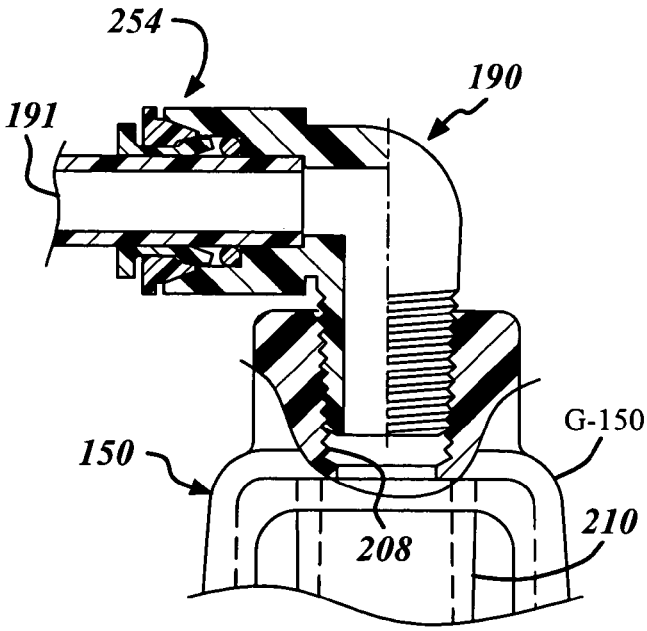
Figure 22:
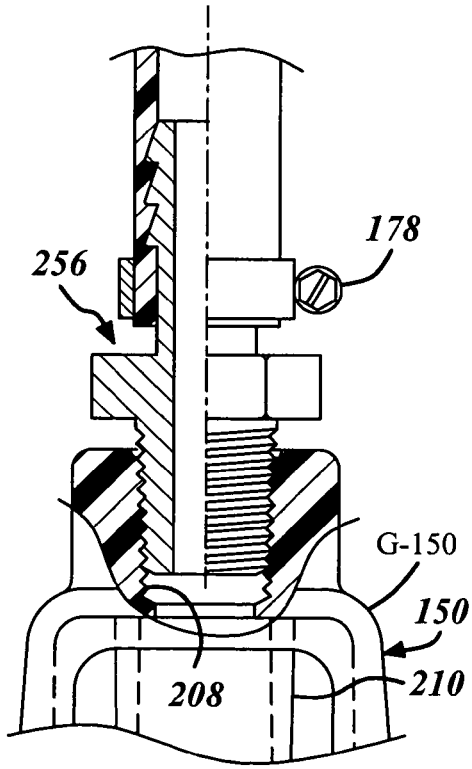

The provision of the ½" female threaded inlet 208 in hex protrusion 206 of adapter 150 accommodates ½" male threaded nipple of commercially available adapter fittings such as the straight line compression fitting 250 shown in FIG. 19 threaded into the female threads of inlet 208 of adapter 150, the soldered joint copper tube adapter 252 shown as an alternative installation in to adapter 150 in FIG. 20, the push-in elbow adapter 254 shown as another alternative installation on adapter 150 in FIG. 21, or the barb insert adapter 256 shown with associated hose clamp 178 as still another alternative installation on adapter 150 in FIG. 22. These same style commercially available coupling nipple adapters are likewise commercially available with a ¾"-14 MP3 male thread to thread into the ¾" female threaded inlet 209 of fitting tube 110 when desiring to couple larger diameter drain line tubing hoses or pipes using air gap adapter 110.

Note that the hex head protrusion 206 at the upper end or the inlet end of fittings 150 and 110 is made with an outside dimension C large enough to accommodate or form either the ½" or ¾" female threaded inlet openings 208 and 209 in adapter 150 and 110 respectively. Adapter 150 (part no. G-150) and adapter 110 (part no. G-175) are otherwise identical. Hence, these parts can be made in the same mold setup by using a removable screw core insert appropriately sized to make one or the other size inlet in the molded part, i.e., using a retractable screw thread mold insert so that the only change needed in the mold to make one or the other parts is to install a different size insert. However, adapter 200 is only designed to slip over the outside of the upper open end of a 2" Schedule-40 drain pipe and not to telescope into the same. Also, adapter 200 does not have the two different sizes of inlet threads that are found in adapters 150 and 110, i.e., it has a dedicated 1" female threaded inlet 282.

Adapter air gap fitting 170 (part no. G-200) shown in FIGS. 10, 12, 17 and 18 is larger in overall dimensions than adapters 150, 175 and is provided with an open mouth at its lower end with a generally cylindrical surface 270 having the maximum diametrical dimension Q and minimum diametrical dimension R that enables a 2" Schedule-40 diameter spigot end of a Schedule-40 pipe to be slip fit therein with a slight clearance for adhesive. This dimension, as set forth in the dimensional table, is maximum of 2.384 inches and a minimum of 2.370 inches. Adapter 170 is not intended to be slip fit within another plumbing part, and hence the thickness of the wall of the hood 280 of adapter 170 is of generally constant thickness rather than increasing in thickness toward the open end of the adapter as in adapters 150 and 110. The female threaded inlet 282 and the hexagonally threaded boss 284 of adapter 170 is sized to be one inch I.D. with 11½MPT threads. Again a draft angle of 1° is provided unless otherwise specified in the wall thickness. The axial dimensions S, T, U, V, W are set forth in the dimensional table hereinafter. Likewise, as to the dimensions labeled N, 0, P in FIG. 18.

Figure 12:
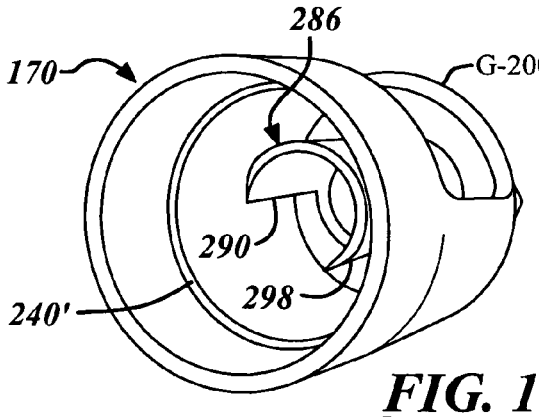
FIG. 12 is a view similar to FIG. 11 but illustrating a part G-200 air gap adapter in a similar orientation.

It is to be noted that adapter 170 also is provided with the interior drain tube 286 but has a larger diameter than tubes 210 in keeping with the larger diameter of inlet 282. However, the lower edge 288 of tube 286 is again positioned generally flush with the lower edge 290 of the single side opening vent window 300 in hood 280 in the manner of adapters 150 and 110. Also as shown in FIG. 12, the interior drain tube 286 is again provided with a side opening defined by gap edges 290 and 292 that encompass approximately 180° of the circumference of the drain tube 286 and are oriented 180° opposite the single side vent opening in hood 280.

Dimensional Table

| Dimension | Inches |
|---|---|
| A | 0.56 |
| B | 0.75 |
| C | 1.50 |
| D | 2.375 |
| E | 1.910 |
| F | 1.895 |
| G | 0.00 |
| H | 0.95 |
| I | 1.06 |
| J | 3.06 |
| K | 3.39 |
| L | 4.20 |
| M | 1.38 |
| N | 1.63 |
| P | 1.625 |
| Q | 2.384 |
| R | 2.370 |
| S | 0.00 |
| T | 1.15 |
| U | 1.26 |
| V | 3.263 |
| W | 3.606 |
| X | 4.62 |

From the foregoing description it now will be evident that the air gap fittings of the invention are well suited for applications where rigid Schedule-40 pipe must be plumbed to an approved air gap device. The disclosed designs are ideally suited to accommodate high drain flow rates. These air gap fittings provide a full vertical two inches of air gap, thereby providing a convenient, ready-made air gap fitting that will readily accommodate plumbing code requirements nationwide. They will satisfy residential and commercial water treatment equipment and condensate lines that require an air gap discharged to the drain and function as a multi-purpose stand pipe air gap. Adapters 150 and 110 feature the ½" or ¾" female thread inlet for versatility of MIPT Schedule-40 nipples and adapters as illustrated by way of example in FIGS. 19-22. They install telescopically over and onto a 1½" ABS or PVC Schedule-40 stand pipe or, alternatively with the same fitting, they fit into a hub/socket coupling for 2" ABS or PVC Schedule-40 fittings.

Another feature common to parts G-150 and G-175 is that the outside surface 230 of the hood 200 is made at a straight tapering angle so as to be narrower at the top and wider at the bottom. The inside wall 232 of the hood 200 is generally a right cylindrical surface with only a slight draft angle (e.g., 1°). Hence, the wall thickness of the hood increases from top to bottom or from the inlet end toward the outlet end. This additional material thickness enables the G-150 and G-175 parts to be formed with the appropriate I.D. and O.D. at the outlet end of the hood to both telescope over or telescope into the standard 1½" or 2" Schedule-40 drain parts. This increasing wall thickness also enables cylindrical outlet counter bore 242 to be molded into the part to provide essentially a right cylindrical surface for telescopic slide fit reception (with glue clearance) of the upper end of the drain pipe 156 when the air gap hood is telescoped over the outside of the drain pipe (FIG. 5). Since the wall thickness decreases in hood 200 toward the inlet end of adapters 110 and 150, there is a saving in material in the adapter while still accommodating the alternate-mount outlet end feature.

Still another feature of all embodiment parts G-150, G-175 and G-200) is the full 360° circular interior ledge 240, 240' in the hood that provides an accurate slip-in stop for the air gap when it is being installed telescopically over the outside of a drain pipe, thereby providing a very strong and reliable stop as compared to interrupted stop tabs. This positive stop feature prevents the inlet end of a standpipe from protruding up beyond and into the airgap window and thereby causing an obstruction interference with the strict code requirements of the operation of the airgap device.

Preferably, these adapters 110, 150 and 170 are all molded in one piece from white ABS resin to ASTM specifications for 1½" and 2" Schedule-40 pipe and fittings. They provide a solid air gap drain connection that ensures a safe and professional installation, and are operable to prevent splash or spray from escaping through the air gap window even under high flow rate conditions. They enable a fast and easy installation, fully meet IAPMO/UPC specifications and are listed as such, as well as ASME Standard A112.1.3 for airgap devices. They are designed to be cemented with an approved ABS cement for ABS pipe connections, or ABS to PVC transition cement such as Oatey or Hercules that are NSF certified and meet ASTM D 3138 specification in connecting to PVC pipe.

Adapter 170 (part no. G-200) is designed to satisfy the need for multi-purpose stand pipe air gap for commercial water treatment equipment and condensate lines that require an air gap discharge to the drain using Schedule-40 DWV stand pipes. Adapter 170 accommodates a 1" male nipple adapter in its threaded female inlet and easily installs over 2" ABS or PVC Schedule-40 stand pipes.

It will thus be seen that the air gap adapters of the invention as disclosed and claimed herein will satisfy the need for high flow rate Schedule-40 stand pipe air gaps to satisfy the request by numerous plumbing supply houses, plumbing contractors and water treatment equipment installers around the country and abroad as a result of the new high-performance "Dual Head" water softener controls with high discharge rates. Manufacturers can now be provided with the necessary plumbing drain connections to satisfy the plumbing codes in almost all, if not all, locales. This will obviate the illegal practice of the installer creating some kind of on-site connection that may discharge waste water into the drain but will not, in many cases, depending on the plumbing inspector and local plumbing codes, pass the required plumbing inspection.

The invention claimed is:

1. A drain line adapter in the form of an air gap fitting for fluid flow coupling the outlet of a waste water discharge conduit of water consuming and/or water treating appliance to an upwardly facing inlet opening of a sewer stand pipe and for providing at such air gap coupling point an air gap that ensures a point of separation of potable and non-potable liquid conduits to thereby avoid a direct drain connection of potable liquid conduits to a sewer system, i.e., an undesirable cross connection, to thereby eliminate a risk of contamination of potable liquid when a sewer backs up or when there is a loss of pressure in the water supply side of the conduit system, said air gap fitting comprising an ABS or PVC part molded in one piece and having a generally bell-shaped hood defined by a transverse top wall portion merging at a radially outer circular edge thereof with a hood side wall portion of generally cylindrical shape but tapering divergently in a direction downwardly from said transverse top wall portion, said side wall portion terminating at its lower end in a cylindrical skirt portion defining the outlet end of said air gap fitting, said skirt portion having an inner peripheral wall of generally cylindrical shape but having a diameter at the lower edge of said skirt with a predetermined dimension E or Q, said skirt inner peripheral wall extending axially from the bottom open end edge of said hood toward said transverse top wall portion a distance of about one inch and terminating at a 360° internal shoulder that forms an interior ledge to provide an accurate and rugged slip-stop for the air gap fitting when it is being installed telescopically over the outside of the inlet end of said sewer stand pipe, said hood skirt portion having an inner diameter dimension F or R at its junction with said shoulder ledge less than the aforesaid corresponding dimensions E or Q such that said inner peripheral wall has a slight convergent taper in the direction toward the upper end of said hood so that said hood is adapted to receive said stand pipe upper end with a slight clearance fit to provide for a solvent welding cement application between the stand pipe upper end and the skirt inner periphery, said hood having a single air vent opening in said sidewall portion that extends axially of said hood approximately two inches in the region between said transverse top wall portion of said hood and said interior slip-stop shoulder ledge, said air vent window opening having a dimension circumferentially of said hood of just slightly less than the aforementioned dimensions F and R, said fitting having an interior drain air vent tube joined integrally at its upper end to an interior surface of said transverse top wall portion of said hood and extending downwardly axially and centrally of said hood and terminating at an open lower edge at an elevation generally flush with the lower edge of said sidewall portion air vent opening, said hood interior drain tube having an interior air vent gap slot open at said lower end of said interior drain tube and defined by gap side edges that extend almost to said hood top wall portion to thereby form an interior air gap inside said hood spaced from the interior wall thereof and angularly offset so as to be oriented 180° out of alignment with said hood side window forming the exterior air vent in the hood to thereby greatly reduce splash during operation of the air gap adapter fitting, said air gap fitting having a protrusion extending axially from the exterior of said hood top wall portion and having a hexagonally shaped periphery for receiving a wrench to rotate the fitting or resist rotation of the fitting as needed, said protrusion having an outside dimension large enough to accommodate forming an inlet through opening in the protrusion provided with either a ½", ¾", or 1" I.D. female thread that communicates with the upper end of the interior air gap vent tube.

2. The air gap fitting of claim 1 wherein said hexagonal protrusion has ½" NPT female threads.

3. The air gap fitting of claim 1 wherein said hexagonal protrusion has ¾" NPT female threads.

4. The air gap fitting of claim 1 wherein said hexagonal protrusion has 1" NPT female threads.

5. The air gap fitting of claim 1 wherein said hood sidewall portion has a tapering thickness dimension transverse to the center axis of revolution of said fitting so that said sidewall portion increases in thickness from that of said transverse top wall to a predetermined greater thickness providing an outside dimension in said skirt portion adapted to a slip-fit with a slight clearance into a connector hub made to fit a 2" Schedule-40 no-hub stand pipe riser, said hood skirt portion inner periphery having an inside diameter at the lower edge of said skirt portion adapted to telescopically receive therein with a slight clearance the outside surface of a 1½" Schedule-40 no-hub stand pipe riser.

6. The air gap fitting of claim 5 wherein said hexagonal protrusion has ½" NPT female threads.

7. The air gap fitting of claim 5 wherein said hexagonal protrusion has ¾" NPT female threads.

8. A drain line adapter in the form of an air gap fitting for fluid flow coupling the outlet of a waste water discharge conduit of water consuming and/or water treating appliance to an upwardly facing inlet opening of a sewer stand pipe and for providing at such air gap coupling point an air gap that ensures a point of separation of potable and non-potable liquid conduits to thereby avoid a direct drain connection of potable liquid conduits to a sewer system, i.e., an undesirable cross connection, to thereby eliminate a risk of contamination of potable liquid when a sewer backs up or when there is a loss of pressure in the water supply side of the conduit system, said air gap fitting comprising an ABS or PVC part molded in one piece and having a generally bell-shaped hood defined by a transverse top wall portion merging at a radially outer circular edge thereof with a hood side wall portion of generally cylindrical shape but tapering divergently in a direction downwardly from said transverse top wall portion, said side wall portion terminating at its lower end in a cylindrical skirt portion defining the outlet end of said air gap fitting, said skirt portion having an inner peripheral wall of generally cylindrical shape but having a diameter at the lower edge of said skirt with a predetermined dimension E or Q, said skirt inner peripheral wall extending axially from the bottom open end edge of said hood toward said transverse top wall a distance of about one inch and terminating at a 360° internal shoulder that forms an interior ledge to provide an accurate and rugged slip-stop for the air gap fitting when it is being installed telescopically over the outside of the inlet end of said sewer stand pipe, said hood skirt portion having an inner diameter dimension F or R at its junction with said shoulder ledge less than the aforesaid corresponding dimensions E or Q such that said inner peripheral wall has a slight convergent taper in the direction toward the upper end of said hood so that said hood is adapted to receive said stand pipe upper end with a slight clearance fit to provide for a solvent welding cement application between the stand pipe upper end and the skirt inner periphery, said hood having a single air vent opening in said sidewall portion that extends axially of said hood approximately two inches in the region between said transverse top wall portion of said hood and said interior slip-stop shoulder ledge, said air vent window opening having a dimension circumferentially of said hood of just slightly less than the aforementioned dimensions F and R, said fitting having an interior drain air vent tube joined integrally at its upper end to an interior surface of said transverse top wall portion of said hood and extending downwardly axially and centrally of said hood and terminating at an open lower edge at an elevation generally flush with the lower edge of said sidewall portion air vent opening, said hood interior drain tube having an interior air vent gap slot open at said lower end of said interior drain tube and defined by gap side edges that extend almost to said hood top wall portion to thereby form an interior air gap inside said hood spaced from the interior wall thereof and angularly offset so as to be oriented 180° out of alignment with said hood side window forming the exterior air vent in the hood to thereby greatly reduce splash during operation of the air gap adapter fitting, said air gap fitting having a protrusion extending axially from the exterior of said hood top wall portion and having a hexagonally shaped periphery for receiving a wrench to rotate the fitting or resist rotation of the fitting as needed, said protrusion having an outside dimension large enough to accommodate forming an inlet through opening in the protrusion provided with either a ½", ¾", or 1" I.D. female thread in that communicates with the upper end of the interior air gap vent tube, and wherein said hexagonal protrusion inlet has ½" or ¾" NPT female threads, and wherein said fitting has threadably mounted in said protrusion threaded inlet a conventional adapter for coupling the air gap fitting to a waste water drain line of an appliance, said conventional coupling adapter being selected from the group consisting of:

(1) a conventional compression adapter in either straight line or elbow configuration,
(2) a straight line soldered-in copper tubing adapter,
(3) a push-in straight line or elbow configuration push-in adapter, and
(4) a straight line or elbow configuration hose barb adapter using hose clamp securement of a hose received over the barbs.

Figure 15:
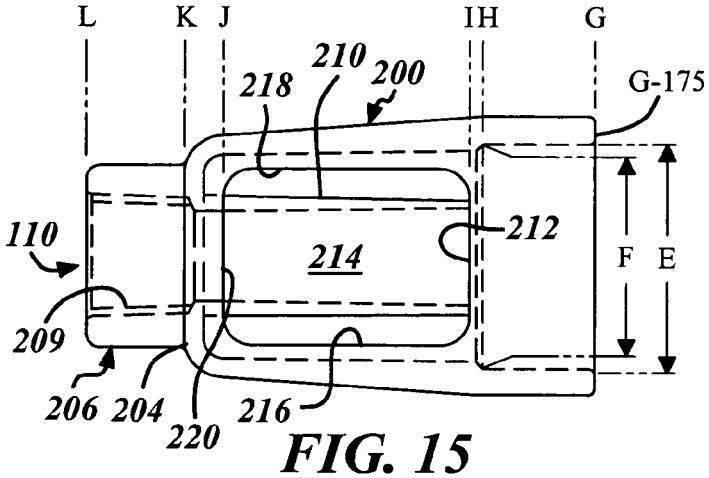
FIGS. 15 and 16 are respectively side elevational and upper end plan views of a part G-175 adapter.
Figure 16:
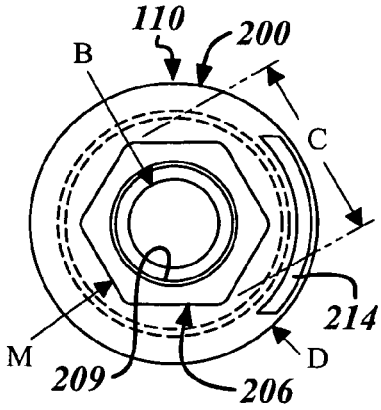
Figure 17:
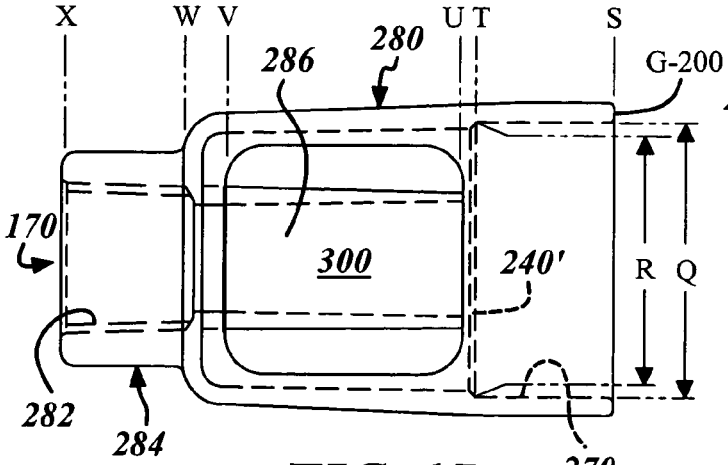
FIGS. 17 and 18 are respectively side elevational and upper end plan views of a part G-200 adapter of the invention.
Figure 18:
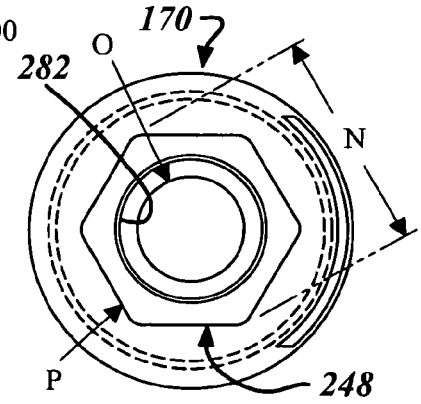

9. The air gap fitting of claim 1 wherein the adapter is made to specified dimensions selected from the group consisting of:

(1) the dimensions specified A through M as labeled in FIGS. 15 and 16 of the drawings and set forth in the Dimensional Table on page 15 of the description set forth hereinbefore, and
(2) the dimensions specified N through X as labeled in FIGS. 17 and 18 of the drawings and set forth in the Dimensional Table on page 15 of the description set forth hereinbefore.

10. A method of providing an air gap for fluid flow coupling the outlet of a waste water discharge conduit of water consuming and/or water treating appliance to an upwardly facing inlet opening of a sewer stand pipe and for providing at such air gap coupling point an air gap that ensures a point of separation of potable and non-potable liquid conduits to thereby avoid a direct drain connection of potable liquid conduits to a sewer system, i.e., an undesirable cross connection, to thereby eliminate a risk of contamination of potable liquid when a sewer backs up or when there is a loss of pressure in the water supply side of the conduit system, said method comprising the steps of:

(1) providing an air gap fitting comprising an ABS or PVC part molded in one piece and having a generally bell-shaped hood defined by a transverse top wall portion merging at a radially outer circular edge thereof with a hood side wall portion of generally cylindrical shape but tapering divergently in a direction downwardly from said transverse top wall portion, said side wall portion terminating at its lower end in a cylindrical skirt portion defining the outlet end of said air gap fitting, (2) providing said skirt portion with an inner peripheral wall of generally cylindrical shape but having a diameter at the lower edge of said skirt with a predetermined dimension E or Q, said skirt inner peripheral wall extending axially from the bottom open end edge of said hood toward said transverse top wall portion a distance of about one inch to an upper edge thereof, (3) forming a 360° internal shoulder at said upper edge of said inner peripheral wall to serve as an accurate and rugged slip-stop annular ledge for the air gap fitting when it is being installed telescopically over the outside of the inlet end of said sewer stand pipe, (4) providing said hood skirt portion with an inner diameter dimension F or R at its junction with said shoulder ledge that is less than the aforesaid corresponding dimensions E or Q such that said inner peripheral wall has a slight convergent taper in the direction toward the upper end of said hood so that said hood is adapted to receive said stand pipe upper end with a slight clearance fit to provide for a solvent welding cement application between the stand pipe upper end and the skirt inner periphery, (5) providing a single air vent opening in said hood sidewall portion that extends axially of said hood approximately two inches in the region between said transverse top wall portion of said hood and said interior slip-stop shoulder ledge, said air vent window opening having a dimension circumferentially of said hood of just slightly less than the aforementioned dimensions F and R, (6) providing said fitting with an interior drain air vent tube joined integrally at its upper end to an interior surface of said transverse top wall portion of said hood and extending downwardly axially and centrally of said hood and terminating at an open lower edge at an elevation generally flush with the lower edge of said sidewall portion air vent opening, (7) providing said hood interior drain tube with an interior air vent gap slot open at said lower end of said interior drain tube and defined by gap side edges that extend almost to said hood top wall portion to thereby form an interior air gap inside said hood spaced from the interior wall thereof and angularly offset so as to be oriented 180° out of alignment with said hood side window forming the exterior air vent in the hood to thereby greatly reduce splash during operation of the air gap adapter fitting, and (8) providing said air gap fitting with a protrusion extending axially from the exterior of said hood top wall portion and having a hexagonally shaped periphery for receiving a wrench to rotate the fitting or resist rotation of the fitting as needed, said protrusion having an outside dimension large enough to accommodate forming an inlet through opening in the protrusion provided with either a ½", ¾", or 1" I.D. female thread that communicates with the upper end of the interior air gap vent tube.

* * * * *